United States Patent [19]

Stevenson

[11] Patent Number: 4,862,841

[45] Date of Patent: Sep. 5, 1989

[54] INTERNAL COMBUSTION ENGINE

[76] Inventor: John C. Stevenson, 6415 E. 87th Pl., Tulsa, Okla. 74133

[21] Appl. No.: 235,549

[22] Filed: Aug. 24, 1988

[51] Int. Cl.[4] ..... F02B 1/06

[52] U.S. Cl. ..... 123/52 MV; 123/316

[58] Field of Search ..... 123/52 MF, 52 MV, 76, 123/316

[56] References Cited

U.S. PATENT DOCUMENTS

| | | | |
|---|---|---|---|
| 1,610,888 | 12/1926 | Sauer | 123/316 |
| 2,344,993 | 3/1944 | Lysholm . | |
| 2,999,491 | 9/1961 | Harkness . | |
| 3,057,336 | 10/1962 | Hatz, Jr. . | |
| 3,416,502 | 12/1968 | Weiss . | |
| 3,540,424 | 11/1970 | Deitel | 123/182 |
| 3,919,986 | 11/1975 | Goto . | |
| 3,976,039 | 8/1976 | Henault . | |
| 3,986,351 | 10/1976 | Woods et al. | 60/274 |
| 4,033,304 | 7/1977 | Luria | 123/78 A |
| 4,084,556 | 4/1978 | Villella . | |
| 4,174,683 | 11/1979 | Vivian | 123/48 C |
| 4,192,265 | 3/1980 | Amano et al. . | |
| 4,232,641 | 11/1980 | Curtil | 123/76 |
| 4,261,307 | 4/1981 | Oldberg | 123/90.15 |
| 4,312,308 | 1/1982 | Slattery | 123/182 |
| 4,442,809 | 4/1984 | Nohira et al. | 123/316 |
| 4,484,543 | 11/1984 | Maxey | 123/80 BA |
| 4,485,780 | 12/1984 | Price et al. | 123/321 |
| 4,539,946 | 9/1985 | Hedelin | 123/48 A |
| 4,572,114 | 2/1986 | Sickler | 123/21 |

FOREIGN PATENT DOCUMENTS

| | | | |
|---|---|---|---|
| 2730608 | 1/1979 | Fed. Rep. of Germany | 123/316 |
| 0047121 | 3/1983 | Japan | 123/316 |
| 0122315 | 7/1983 | Japan | 123/316 |
| 0135318 | 8/1983 | Japan | 123/316 |
| 0180722 | 10/1983 | Japan | 123/316 |
| 1587842 | 4/1981 | United Kingdom | 123/316 |

OTHER PUBLICATIONS

Exhibit D-Internal Combustion Engines, Obert, Second Edition, 1950, pp. 162-174.

Exhibit A-Ed Iskenderian Racing Cams, 1984 catalog, pp. 112-113 and 118-128.

Exhibit B-Gas Engine Manual, Pipe, 1981 Edition, pp. 87-92.

Exhibit C-Standard Handbook for Mechanical Engineers, Baumeister, 7th Ed. (1967), pp. 9-108.

Exhibit A: *The Oxford English Dictionary* vol. I, 1933 pp. 599-601.

Exhibit B: Obert, Edward, *Internal Combustion Engines,* 1950 pp. 161-162, 364, 365.

*Primary Examiner*—David A. Okonsky

*Assistant Examiner*—Weilun Lo

*Attorney, Agent, or Firm*—Mark G. Kachigian

[57] ABSTRACT

A system of generating power in a multi-cylinder internal combustion engine. Each cylinder has a reciprocating piston passing in sequence through an intake stroke, a compression stroke, a power stroke and an exhaust stroke. A charge is drawn from an intake manifold through an intake valve and into a cylinder during the intake stroke. Greater than half of a volume of the cylinder is displaced, thereby returning a substantial portion of the charge to the intake manifold through the intake valve during the compression stroke at all operating speeds. The remaining charge in the cylinder is compressed during the compression stroke after closing the intake valve. The charge is ignited to expand the charge and liberate energy during the power stroke. The cylinder is exhausted of burned charge during the exhaust stroke. The quantitative expansion of the charge during the power stroke is at least twice the quantitative compression of the charge during the compression stroke.

6 Claims, 6 Drawing Sheets

INTERNAL COMBUSTION ENGINE

BACKGROUND OF THE INVENTION

1. Field of the Invention.

The present invention relates to an improved internal combustion engine having a higher thermal efficiency than existing engines. In particular, the present invention relates to an improved internal combustion engine wherein the quantitative expansion of the charge during the power stroke is at least twice the quantitative compression of the charge during the compression stroke.

2. Prior Art.

Internal combustion engines using reciprocating pistons are well known. Pistons slide back and forth within cylinders and transmit power through a connecting rod to a crank shaft. Each cylinder has an intake valve for delivering a charge and an exhaust valve.

The traditional cycle for an internal combustion engine has a defined sequence of operations. An intake stroke draws a charge into a cylinder through its intake valve which is open. A compression stroke compresses the charge in the cylinder with both intake and exhaust valves being closed, raising the temperature and pressure of the charge. During a power stroke, ignition and burning of the charge takes place liberating energy and further raising the temperature and pressure of the gases. Pressure forces the piston downward with both valves closed. Finally, an exhaust stroke sweeps the cylinder free of the burned gases with the exhaust valve open.

Each stroke represents one-half of a revolution of the crank shaft or 180 crank degrees. Two revolutions of the crank shaft complete one cycle of the four strokes. A cam shaft is connected at a 1–2 ratio to the crank shaft and, therefore, revolves once each two turns of the crank.

Internal combustion engines operate by sustaining two nearly simultaneous processes: combustion whereby chemical energy is transformed into heat energy, and expansion of hot gases whereby heat energy is transformed into mechanical energy, work. Each process is relatively inefficient.

Early engines utilized valve timing where the intake valve would close during the intake stroke when the piston was at bottom dead center. It was discovered that engine power could be improved by lengthening the time that the intake valve was open. The intake valve was left open for a period of time after bottom dead center to take advantage of the inertia of the incoming fuel and air charge. Stretching of the intake valve timing allowed the cylinders to breathe deeper and take in a greater amount of fuel and air charge.

The ultimate object of these engines is to trap the greatest possible mass of fuel and air charge in the cylinders during the intake stroke to attain the greatest volumetric efficiency.

The present invention takes a diametrically different approach. The present invention utilizes a significantly smaller mass of fuel and air charge than the maximum possible mass of charge.

The present invention operates to transform more heat energy into work achieving a higher thermal efficiency using presently commercially available fuels.

A patentability search was conducted on the present invention and the following U.S. patents were uncovered.

| U.S. Pat. No. | PATENTEE | ISSUE DATE |
|---|---|---|
| 2,344,993 | A. Lysholm | March 28, 1944 |
| 2,999,491 | J. R. Harkness | September 12, 1961 |
| 3,057,336 | E. Hatz, Jr. | October 9, 1962 |
| 3,416,502 | J. Weiss | December 17, 1968 |
| 3,540,424 | Dietel | November 17, 1970 |
| 3,919,986 | Goto | November 18, 1975 |
| 3,976,039 | Henault | August 24, 1976 |
| 3,986,351 | Woods et al. | October 19, 1976 |
| 4,033,304 | Luria | July 5, 1977 |
| 4,084,556 | Villella | April 18, 1978 |
| 4,174,683 | Vivian | November 20, 1979 |
| 4,192,265 | Amano et al. | March 11, 1980 |
| 4,232,641 | Curtil | November 11, 1980 |
| 4,261,307 | Oldberg | April 14, 1981 |
| 4,312,308 | Slattery | January 26, 1982 |
| 4,442,809 | Nohira et al. | April 17, 1984 |
| 4,484,543 | Maxey | November 27, 1984 |
| 4,485,780 | Price et al. | December 4, 1984 |
| 4,539,946 | Hedelin | September 10, 1985 |
| 4,572,114 | Sickler | February 25, 1986 |

In Goto (No. 3,919,986) a third, additional valve is provided for a part of the charge to flow back into a suction pipe in order to control the output of the engine.

Dietel (No. 3,540,424) discloses variable release decompression valves for lowering compression. Henault (No. 3,976,039) discloses variable valve closings in order to adjust the richness of the charge. Woods et al. (No. 3,986,351) discloses third valves modifying existing engines to vary the timing. In Vivian (No. 4,174,683), a charge is controlled by intake valves designed to vary the inducted charge by closing variably either during the intake stroke or, alternatively, during different portions of the compression stroke.

Oldberg (No. 4,261,307), Slattery (No. 4,312,308), Maxey (No. 4,484,543) and Hedelin (No. 4,539,946) each disclose variable compression release valves.

Nohira et al. (No. 4,442,809), Curtil (No. 4,232,641), Amano et al. (No. 4,192,265) and Villella (No. 4,084,556) each disclose variable compression release valves wherein each valve releases a portion of the compression into an auxiliary chamber, the auxiliary chamber being used to assist in charging other cylinders.

Harkness (No. 2,999,491) and Hatz, Jr. (No. 3,057,336) both disclose a temporary compression release wherein the release is used to aid in starting the motor.

Lysholm (No. 2,344,993) suggests the desirability of decreasing the volume of charge but accomplishes this through a complicated procedure including restricting the charge inducted on the intake stroke by advancing closure of the intake valve.

None of the references suggest making only minimal modifications to designs of present internal combustion engines while achieving higher thermal efficiency than existing engines.

Accordingly, it is a principal object and purpose of the present invention to provide an improved internal combustion engine having higher thermal efficiency than existing engines without any change or upgrade of fuel.

It is a further object and purpose of the present invention to provide an improved internal combustion engine with less polluting emissions due to decreased use of fuel per unit of work.

It is a further object and purpose of the present invention to provide an improved internal combustion engine which may be constructed with only minimum modifications to existing internal combustion engines. Minimal design and tooling changes would be necessary, there being no additional parts or systems to add cost or complexity.

Additionally, it is an object and purpose of the present invention to provide an improved internal combustion engine emitting less noise than existing engines due to lower pressure upon opening of the exhaust valve at the beginning of the exhaust stroke.

A disclosure document relating to the invention was filed by the inventor on Sept. 25, 1986.

SUMMARY OF THE INVENTION

The present invention provides an improved internal combustion engine for multiple cylinder engines. The quantitative expansion of the gases during the power stroke exceeds the quantitative compression of the gases during the compression stroke. Cylinder housings enclose cylindrical recesses, wherein pistons sealably reciprocate. Each cylinder has an intake valve connected to a common intake manifold.

Five sequential phases of operation for each cylinder constitute the present invention.

In the intake stroke, the intake valve is open while the piston moves downward within a cylindrical recess while a charge is drawn into the combustion chamber from the intake manifold.

In the return phase of the compression stroke, the piston moves upward, after the charge has been fully ingested. A substantial portion of the mass of the charge is returned to the intake manifold as the piston moves upward.

In the remaining or compression phase of the compression stroke, the intake valve closes so that the combustion chamber is completely sealed. The remaining charge is compressed to a fraction of its original volume.

In the power stroke, the charge is ignited with the heat of combustion expanding the gasses in the chamber, forcing the piston downward. Work is accomplished throughout the entire downstroke.

In the exhaust stroke, the piston moves upward, pushing the burned gases out of the combustion chamber through the open exhaust valve and into the exhaust manifold.

DETAILED DESCRIPTION OF THE PREFERRED EMBODIMENT

Figure 1:
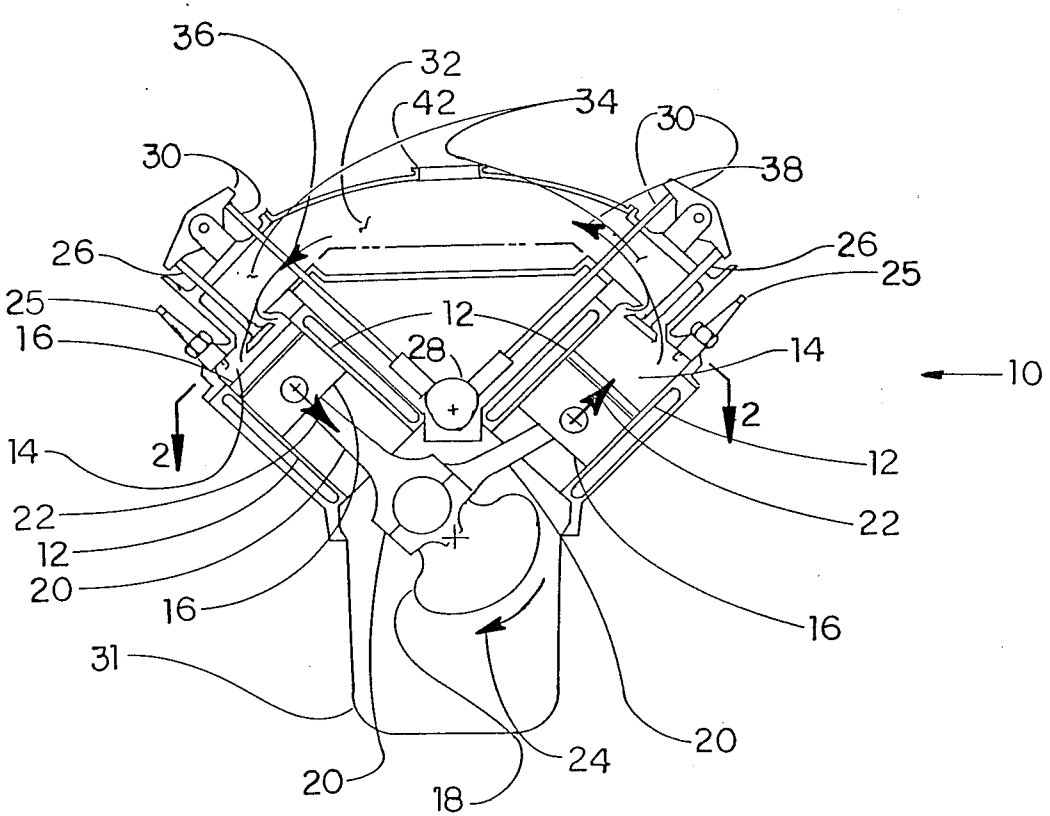
FIG. 1 shows a cut-away view (not to scale) of an internal combustion engine constructed in accordance with the present invention.

Referring to the drawings in detail, FIG. 1 shows a cut-away view of an internal combustion engine 10. The present embodiment is an eight cylinder engine arranged in two banks of cylinders to form a "V". Other cylinder arrangements, such as in-line, may be made consistent with the present invention. Although eight or more cylinders are preferred, it should be understood that other multiple cylinder embodiments may be utilized providing that all cylinders draw their charges from one common intake manifold.

The present embodiment modifies an Otto cycle engine: however, the invention could also be applied to a diesel cycle engine.

As will be described herein, the present invention is more efficient than existing engines because it has a higher thermal efficiency. The thermal efficiency is measured by the work output divided by the energy input.

The engine 10 has cylinder housings 12 in banks of cylinders set at an angle to each other. The cylinder housings 12 enclose cylindrical recesses 14. Within each cylindrical recess 14, a piston 16 sealably reciprocates. Each piston 16 is connected to a crank shaft 18 by a piston rod 20. The direction of movement of pistons 16 is indicated by arrows 22. The direction of movement of the crank shaft 18 is shown by arrow 24.

The space defined by the top of the piston 16 and the walls of the cylindrical recess 14 forms a combustion chamber. A spark plug 25 is in communication with each combustion chamber to ignite a charge delivered thereto.

Two of the eight pistons of the engine are seen in FIG. 1. Each cylinder has an intake valve 26 in communication with the combustion chamber. The intake valves are moved between open and closed positions by a cam shaft 28 and valve operators 30. A typical oil sump pan 31 is connected to the engine 10.

Each cylinder also has an exhaust valve (not shown) which is not visible in FIG. 1. Both of the intake valves 26 seen in FIG. 1 are open. The intake stroke is illustrated by the piston on the left. A charge (not shown) travels from a plenum or intake manifold 32 through an intake passageway 34 and into the combustion chamber. The charge itself will vary dependent on the type of internal combustion engine. For engines such as diesel type that inject fuel directly into the cylinder, the charge will be air. For engines such as Otto type wherein fuel is mixed with air before intake, the charge is a mixture of air and fuel. The direction of flow of the charge during the intake stroke is shown by arrow 36. The beginning of the compression stroke is seen in the cylinder on the right. The intake valve is also open. A portion of the charge is moving out of the combustion chamber through intake passageway 34 and into the intake manifold. The direction of flow of the charge during the return phase of the compression stroke is shown by arrow 38.

A salient feature of the present invention may be observed from the foregoing. In internal combustion engines, there is a tendency for a significant vacuum to be created in the intake manifold. In the present invention, there is less of a tendency for a vacuum to be created because there is always one cylinder pushing a charge back into the intake manifold.

Figure 2:
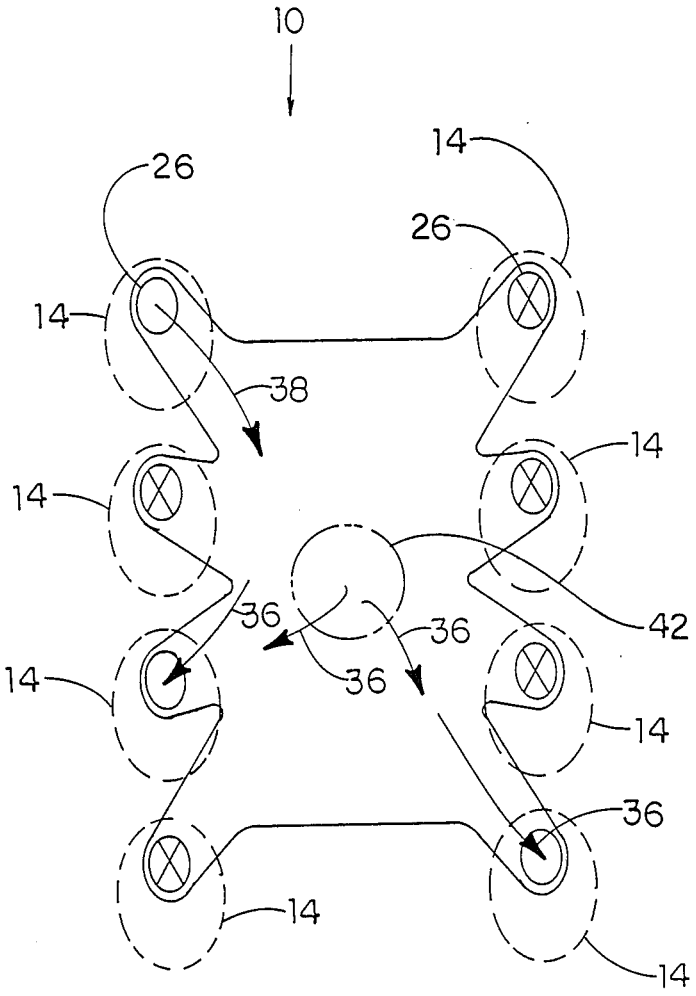
FIG. 2 shows a sectional view of the internal combustion engine shown in FIG. 1 taken along section lines 2—2.

FIG. 2 shows a sectional view of the engine 10 representing the operation of the engine at one particular time. The entrance 42 to the intake manifold is seen. Three intake valves 26 are open while five are closed. The closed intake valves are designated by an "X" across the intake valve. The cylindrical recesses 14 are shown in outline form. Two of the three open intake valves show the charge entering the respective combustion chambers during the intake stroke. The direction of flow of the charge during the intake stroke is shown by arrows 36. One intake valve shows the charge leaving the cylinder during the initial phase of the compression stroke. The direction of flow of the charge during the initial phase of the compression stroke is shown by arrow 38. Each time one cylinder is operating on a return phase of a compression stroke, at least two cylinders are operating on an intake stroke. It should be noted that a one or two piston engine operating in accordance with the present invention may have some undesirable characteristics. Back flow may occur through the intake system because during the return phase of the compression stroke, the piston is sweeping part of the charge back out of the cylinder. In a multicylinder engine, there is always an open and intaking valve. In an eight cylinder engine such as described in the preferred embodiment herein, there are always two open and intaking intake valve.

FIGS. 3 through 7 break down the four traditional strokes of an internal combustion engine into five sequential phases of operation of the present invention. In each, one piston 16 and cylindrical housing 12 are shown, although the following applies to each of the eight pistons 16. In FIGS. 3 through 7, no spark plugs or injection orifices are shown for the sake of clarity.

Figure 3:
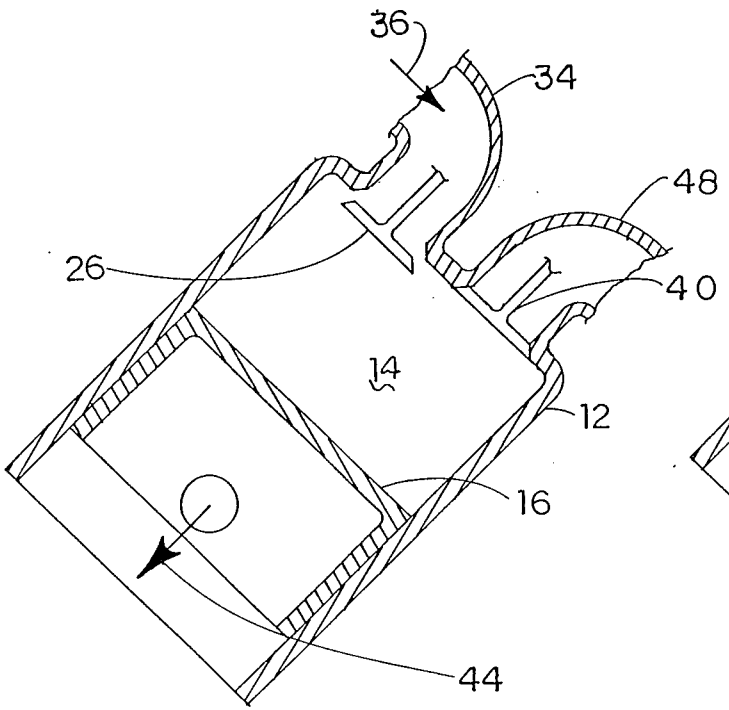
FIG. 3 shows a piston and cylindrical recess of the internal combustion engine shown in FIG. 1 depicting the intake stroke.

FIG. 3 depicts the intake stroke. The intake valve 26 is open while the piston 16 moves downward within the cylindrical recess 14. A charge is drawn into the combustion chamber through intake passageway 34. Arrow 36 shows the direction of the flow of the charge. An exhaust valve 40 is closed so that no exhaust gasses enter through exhaust passageway 48. During the intake stroke, the volume of the combustion chamber increases as the piston moves downward as seen by the direction of arrow 44.

Figure 4:
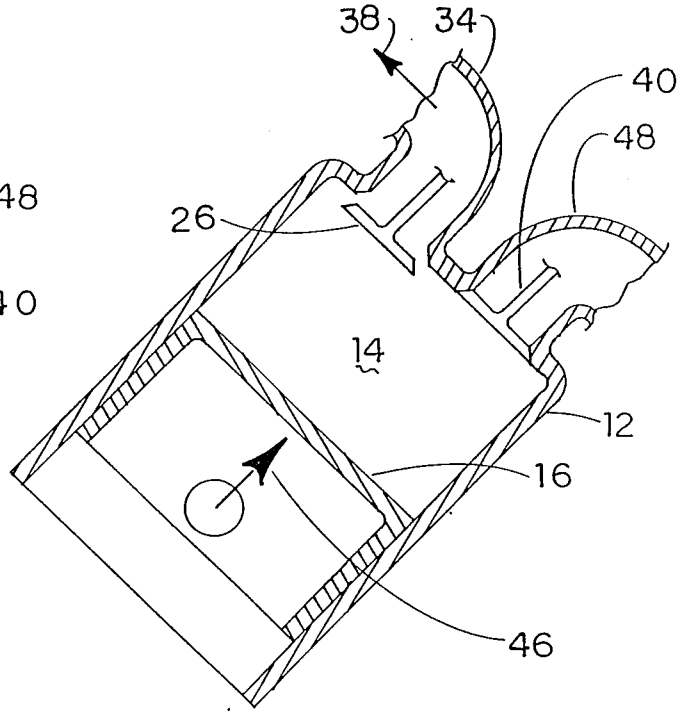
FIG. 4 shows a piston and cylindrical recess of the internal combustion engine shown in FIG. 1 depicting the return phase of the compression stroke.

FIG. 4 shows the return phase of the compression stroke. After a charge has been fully ingested into the combustion chamber, the piston 16 moves upward as shown by arrow 46. The exhaust valve 40 remains closed. During this return phase, over one-half of the volume of the combustion chamber is displaced. The intake valve remains open during the return phase of the compression stroke. A portion of the charge is, thus, returned to the intake manifold as the piston moves upward. Thus, the combustion chamber which was completely filled with the charge is partially purged by sending the unwanted quantity of charge back through the intake valve to some other cylinder. The actual amount of the initially ingested charge which is returned will vary somewhat depending on the operating speed of the engine. In the inventive engine, however, a substantial portion of the charge is always returned to the intake manifold at all operating speeds.

It should be noted that the charge must find an open intake valve elsewhere otherwise backflow could occur at the intake manifold entrance 42 with undesirable results.

Figure 5:
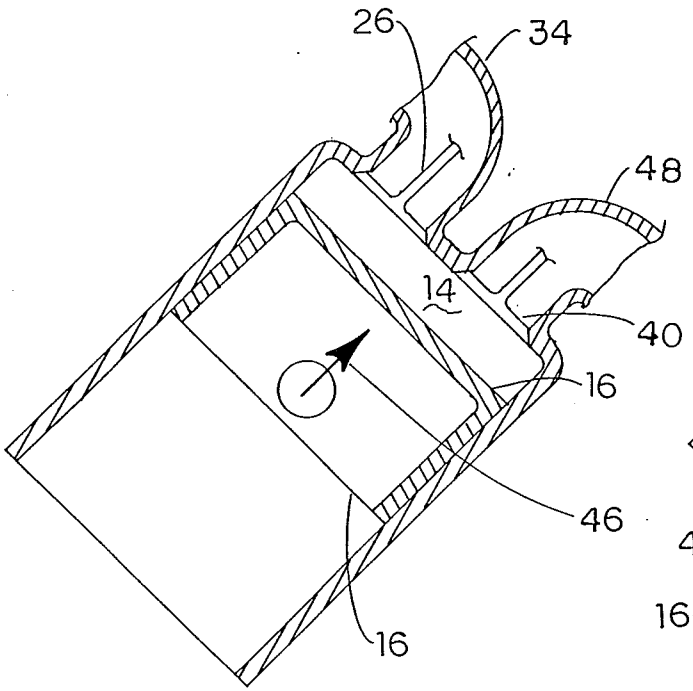
FIG. 5 shows a piston and cylindrical recess of the internal combustion engine shown in FIG. 1 depicting the compression phase of the compression stroke.

FIG. 5 shows the remaining or compression phase of the compression stroke. The intake valve closes so that the combustion chamber is completely sealed. The piston 16 continues its upward movement as shown by arrow 46. The remaining charge in the chamber is compressed to a fraction of its original volume. The quantitative compression of the charge is determined by this change in volume. The phases shown in FIGS. 4 and 5 together comprise the entire compression stroke.

Figure 6:
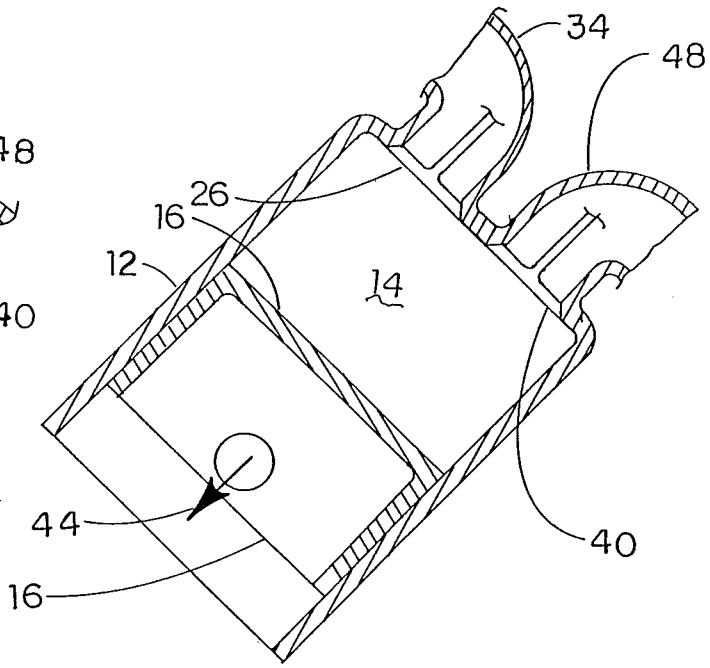
FIG. 6 shows a piston and cylindrical recess of the internal combustion engine shown in FIG. 1 depicting the power stroke.

FIG. 6 depicts the power stroke. After the charge is ignited, the heat of combustion expands the gasses in the combustion chamber, forcing the piston 16 down. Work is accomplished throughout the entire downstroke. The quantitative expansion of the gases during the power stroke exceeds the quantitative compression of the gases during the compression phase of the compression stroke.

Figure 7:
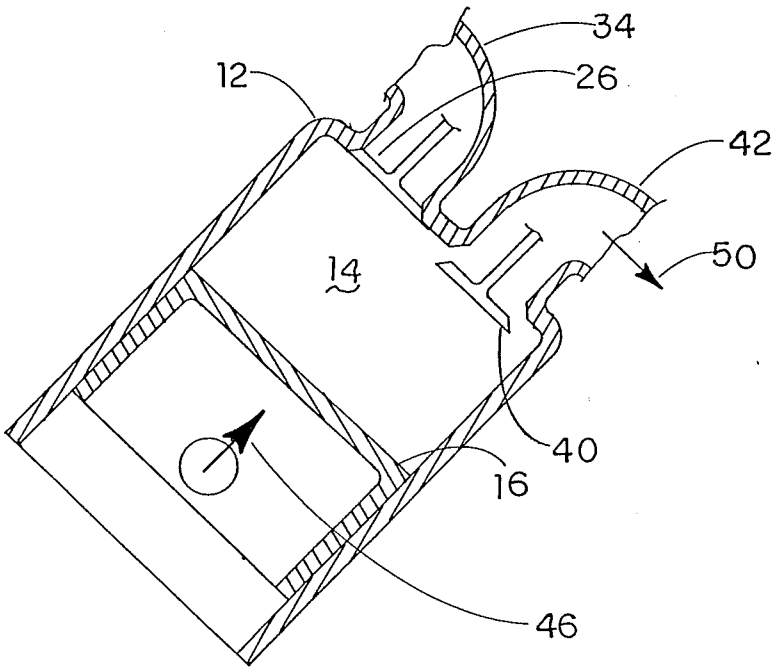
FIG. 7 shows a piston and cylindrical recess of the internal combustion engine shown in FIG. 1 depicting the exhaust stroke.

FIG. 7 shows the exhaust stroke. With the intake valve 26 remaining closed, the exhaust valve 40 is opened. The piston 16 moves upward as shown by arrow 46, pushing the burned gases in the combustion chamber into the exhaust manifold. The direction of flow of the exhaust gases is shown by arrow 50. The cycle then repeats beginning with the intake stroke seen in FIG. 3.

As an example of the invention, an existing automobile internal combustion engine has been modified in accordance with the preferred embodiment of the invention. A 1978 Chevrolet Caprice Classic with a 350 cubic inch V-8 engine was used. The automobile is equipped with a variety of power options, air conditioning and automatic transmission. The engine was modified in accordance with the foregoing description. It was determined that the intake valve should remain open during the return phase of the compression stroke until 112° after bottom dead center or 68° before top dead center. Prior to this time, the valve remains open so that a substantial portion of the initially ingested charge is returned to the intake manifold through the intake valve. This valve timing has been found to be satisfactory at all engine speeds. Although there is insufficient test data to support precise fuel mileage figures, present results indicate a fuel efficiency of approximately 25 miles per gallon in light rural traffic which is believed to be significantly better than results prior to modification.

With the engine thus modified in accordance with the present invention, a gauge was placed on the intake manifold. The vacuum registered in the intake manifold was significantly less than that observed prior to modification. This is consistent with the previous description—although there are always at least two open and intaking valves there is also at least one cylinder which is returning charge to the intake manifold. This action reduces the vacuum in the intake manifold.

Figure 8:
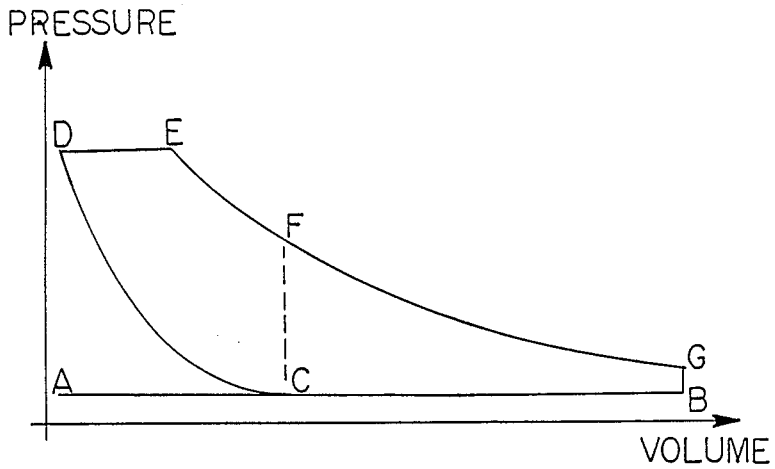
FIG. 8 shows a pressure-volume diagram of the present invention for a diesel type internal combustion engine.

FIG. 8 depicts a pressure-volume diagram (not to scale) for an in cylinder injection type internal combustion engine, such as a diesel engine. As is well known, the work done in the closed cycle is equal to the area enclosed by the cycle in a pressure-volume diagram. The letters on the diagram follow the phases of operation of the present invention as previously described. At point A, the exhaust valve 40 closes and the intake valve opens. Between A and B, the charge is drawn into the combustion chamber as the piston 16 moves downward. Between B and C, the piston reverses direction and moves upward. A substantial portion of the charge ingested into the combustion chamber is pushed back into the intake manifold through the intake valve. At point C, the intake valve closes. Between C and D, the remaining charge in the combustion chamber is compressed. Between D and E fuel is burned as it is injected while the piston begins its downward movement and the expanding hot gasses do work on the piston. Between E and G the gasses expand further doing more work on the piston. The area bounded by FGBCF represents the additional work obtained from the inventive engine from the same amount of fuel consumed in a traditional engine.

Figure 9:
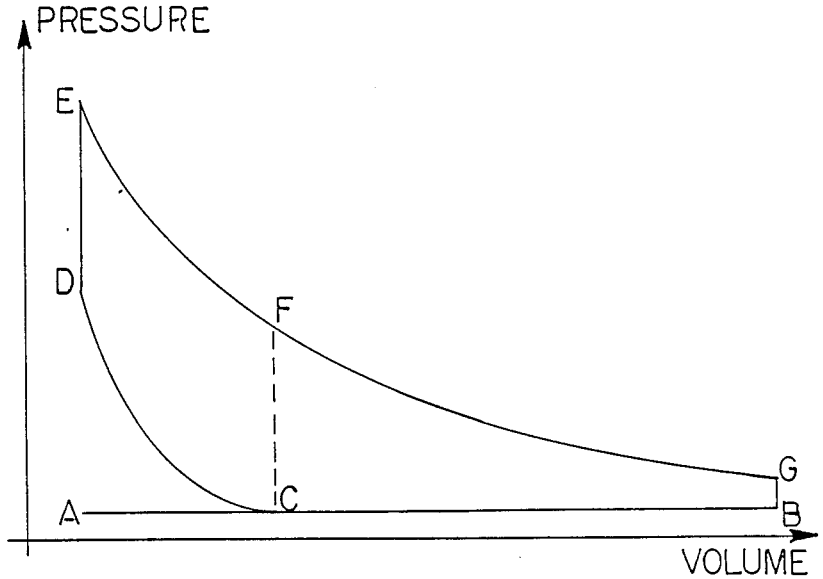
FIG. 9 shows a pressure-volume diagram of the present invention for an Otto type internal combustion engine.

FIG. 9 depicts a pressure-volume diagram (not to scale) for an Otto type internal combustion engine. The only difference between FIGS. 9 and 8 is between D and E. In FIG. 9, the charge, ignited by a spark, burns very quickly while the piston, near top-dead-center, moves very little. No work is considered done between D and E in FIG. 9. The area bounded by FGBCF represents the additional work obtained from the inventive engine from the same amount of fuel consumed in a traditional engine.

The operation of the engine described in the foregoing example may be observed by reference to the pressure-volume diagram shown in FIG. 9. In the 350 cubic inch V-8 engine, over one-half of the volume of the combustion chamber is displaced during the return phase of the compression stroke.

Whereas the present invention has been described in relation to the drawings attached hereto, it should be understood that other and further modifications, apart from those shown or suggested herein, may be made within the spirit and scope of this invention.

What is claimed is:

1. A method of generating power in a multi-cylinder internal combustion engine, each cylinder having a reciprocating piston therein passing in sequence through an intake stroke, a compression stroke, a power stroke and an exhaust stroke, which method comprises: drawing a charge from a single intake manifold common to each cylinder through an intake valve and into a cylinder during said intake stroke; displacing a volume of said cylinder and thereby returning a substantial portion of said charge to said intake manifold through said intake valve during said compression stroke at all operating speeds; compressing the remaining charge in said cylinder during said compression stroke after closing said intake valve; igniting said charge during said power stroke to expand said charge and liberate energy; exhausting said cylinder of burned charge during said exhaust stroke whereby the quantitative expansion of said charge during said power stroke is significantly greater than the quantitative compression of said charge during said compression stroke; and staggering the operation of said cylinders so that while any cylinder is returning said substantial portion of said charge to said intake manifold during said compression stroke at least one other of said cylinders is drawing said charge during said intake stroke.

2. A method of generating power in a multi-cylinder internal combustion engine as set forth in claim 1 wherein the quantitative expansion of said charge during said power stroke is at least twice the quantitative compression of said charge during said compression stroke.

3. A method of generating power in a multi-cylinder internal combustion engine as set forth in claim 1 including closing said intake valve during said compression stroke at approximately 112° after bottom dead center.

4. A multi-cylinder internal combustion engine, each cylinder having a reciprocating piston therein passing in sequence through an intake stroke, a compression stroke, a power stroke and an exhaust stroke, said internal combustion engine comprising: a plurality of intake valve means, each intake vale means in communication with one of said cylinders, each intake valve means being open during said intake stroke to draw a charge into said cylinder and remaining open during part of said compression stroke so that substantial portion of said charge is forced from said cylinder back through said intake valve means at all operating speeds, wherein the operation of said intake valve means are staggered so that while at least one of said intake valve means is forcing a substantial portion of said charge back at least one other of said intake valve means is drawing a charge; and a single intake manifold means common to and in communication with each intake valve means allowing said charge to flow between said intake manifold means and each said cylinder, where by said charge portion force from said cylinder is returned to said intake manifold means during said compression stroke and whereby the quantitative expansion of said charge during said power stroke is significantly greater than the quantitative compression of said charge during said compression stroke.

5. A multi-cylinder internal combustion engine as set forth in claim 4 wherein the quantitative expansion of said charge during said power stroke is at least twice the quantitative compression of said charge during said compression stroke.

6. A multi-cylinder internal combustion engine as set forth in claim 4 wherein each intake valve means remains open during the greater part of said compression stroke until approximately 112° after bottom dead center.

* * * * *